US007347322B2

(12) United States Patent
Cho

(10) Patent No.: US 7,347,322 B2
(45) Date of Patent: Mar. 25, 2008

(54) CAP ALLOWING ADDITION OF ADJUNCT INTO A CONTAINER

(76) Inventor: Young Kook Cho, 2292 Spin Drift Way, Lawrenceville, GA (US) 30043

( * ) Notice: Subject to any disclaimer, the term of this patent is extended or adjusted under 35 U.S.C. 154(b) by 73 days.

(21) Appl. No.: 11/287,071

(22) Filed: Nov. 23, 2005

(65) Prior Publication Data

US 2006/0108135 A1 May 25, 2006

(30) Foreign Application Priority Data

Nov. 23, 2004 (KR) ..... 10-2004-0096417

(51) Int. Cl.
*B65D 25/08* (2006.01)

(52) U.S. Cl. ..... 206/222; 215/DIG. 8

(58) Field of Classification Search ..... 206/219–222, 206/568; 215/10, 257, DIG. 8
See application file for complete search history.

(56) References Cited

U.S. PATENT DOCUMENTS 5,038,951 A * 8/1991 Rizzardi ..... 215/DIG. 8
5,474,209 A * 12/1995 Vallet Mas et al. ..... 206/219
5,782,345 A * 7/1998 Guasch et al. ..... 206/222
6,148,996 A * 11/2000 Morini ..... 206/222
6,840,373 B2 * 1/2005 Gibler et al. ..... 206/219
7,178,683 B2 * 2/2007 Birkmayer et al. .... 215/DIG. 8
2001/0009151 A1 * 7/2001 Hochrainer ..... 128/200.14
2005/0161348 A1 * 7/2005 Morini ..... 206/219

* cited by examiner

*Primary Examiner*—Luan K Bui

(57) ABSTRACT

Disclosed herein is a cap having a lower cap coupled with an upper cap. The lower cap has an insertion part defining an adjunct receiving chamber formed therein. The upper cap has a security band removeably connected thereto by a connection member. Also an inner skirt extends downward from the upper cap and extends into the insertion part of the lower cap. A push bar extends downwards from the inner skirt further into the insertion part of the lower cap. The insertion part of the lower cap has a bottom opening, which is covered with a bottom cover joined along a bottom circumferential edge of the insertion part surrounding the bottom opening of the insertion part. The bottom circumferential edge of the insertion part is angled to have a downward slope with respect to a lateral direction. The push bar of the upper cap is positioned so that a lower end of the push bar is positioned at a lowest part of the insertion part. The push bar and bottom cover is formed so that a rotation of the upper cap in a predetermined direction will cause the push bar to cut the bottom cover to expose the bottom opening and discharge the adjunct therethrough, and further rotation will cause rotation of the lower cap and eventual detachment of the lower cap and upper cap from the container.

4 Claims, 5 Drawing Sheets

CAP ALLOWING ADDITION OF ADJUNCT INTO A CONTAINER

BACKGROUND OF THE INVENTION

1. Field of the Invention

The present invention relates generally to caps allowing the addition of adjuncts. More particularly, the present invention relates to caps having an adjunct in a chamber defined therein and releasing the adjunct with a predetermined rotation of a portion of the cap.

2. Description of the Related Art

Generally, a technique, in which medical powder or an adjunct, which have been stored in a cap of a container, is added into the container when the cap is pushed downwards, is well known. A representative example of this technique is shown in an illustration of a prior art shown in FIG. 1 through FIG. 3. As shown in FIG. 1, which is an exploded view of the prior art, contents are contained in a container, which has an open upper end. A lower cap 1 is coupled to an opening of a neck part of the container. The lower cap 1 includes an insertion part 3 which extends a predetermined length downwards from an upper end 2 of the lower cap 1 and defines an adjunct receiving chamber 4 therein. A thin film 5 forms a bottom of the insertion part 3 of the lower cap 1. A pipe body 6 of an upper cap 8 is fitted into the adjunct receiving chamber 4 of the lower cap 1. A frictional ring 7 is provided on a circumferential outer surface of the pipe body 6 of the upper cap 8.

To use the conventional cap, the upper cap, which has been in the state of FIG. 2, is pushed downwards. Then, as shown in FIG. 3, the thin film 5 that forms the bottom 11 of the insertion part 3 breaks, so that the adjunct 9, which has been in the pipe body 6 of the upper cap 8, is input into the container 12, thus forming a mixture 10.

This technique has an advantage of ease of addition of the adjunct 9. However, this technique is problematic in that, when it is desired for a user to use the mixture, it is not easy to open the lower cap 1.

Furthermore, because the state of the upper cap when pushed is not easily distinguished from the normal state of the upper cap, it is difficult for the user to determine whether the container has already been used or not As well, after the cap has been separated from the container and part of the mixture has been used, if the container is covered again with the cap to store remaining mixture, when the user desires to use the remaining mixture, it is not easy to open the cap, thus being inconvenient to the user.

SUMMARY OF THE INVENTION

Accordingly, the present invention has been made keeping in mind the above problems occurring in the prior art, and an object of the present invention is to provide a cap in which the addition of an adjunct is performed by a cap rotating method rather than by a cap pushing method.

Another object of the present invention is to provide a cap which includes upper and lower caps each having a means to let a user know whether the adjunct has been added or not and whether the contents of the container have been used or not.

A further object of the present invention is to provide a cap in which the upper and lower caps are coupled to each other through a rib coupling structure such that a single rotation of the upper cap in one direction will cause the adjunct to be released and further rotation of the upper cap will further rotate and open the lower cap, thus consecutively performing the addition of the adjunct and the removal of the upper and lower caps from the container.

In order to accomplish the above objects, the present invention provides a cap having a lower cap coupled with an upper cap. The lower cap has an insertion part defining an adjunct receiving chamber formed therein. The lower cap is the portion of the cap, which rotatably attaches to a container. A coupling part is provided extending upward from the insertion part in the lower cap. The upper cap is coupled to the coupling part of the lower cap. The upper cap has a security band removeably connected thereto by a connection member. Also an inner skirt extends downward from the upper cap and extends into the insertion part of the lower cap. A push bar extends downwards from the inner skirt further into the insertion part of the lower cap. The insertion part of the lower cap has a bottom opening, which is covered with a bottom cover joined along a bottom circumferential edge of the insertion part surrounding the bottom opening of the insertion part. The bottom circumferential edge of the insertion part is angled to have a downward slope with respect to a lateral direction. The push bar of the upper cap is positioned so that a lower end of the push bar is positioned at a lowest part of the insertion part The push bar and bottom cover is formed so that a rotation of the upper cap in a predetermined direction will cause the push bar to cut the bottom cover to expose the bottom opening and discharge the adjunct therethrough, and further rotation will cause rotation of the lower cap and eventual detachment of the lower cap and upper cap from the container.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a preferred embodiment of the present invention will be described in detail with reference to the attached drawings.

Figure 1:
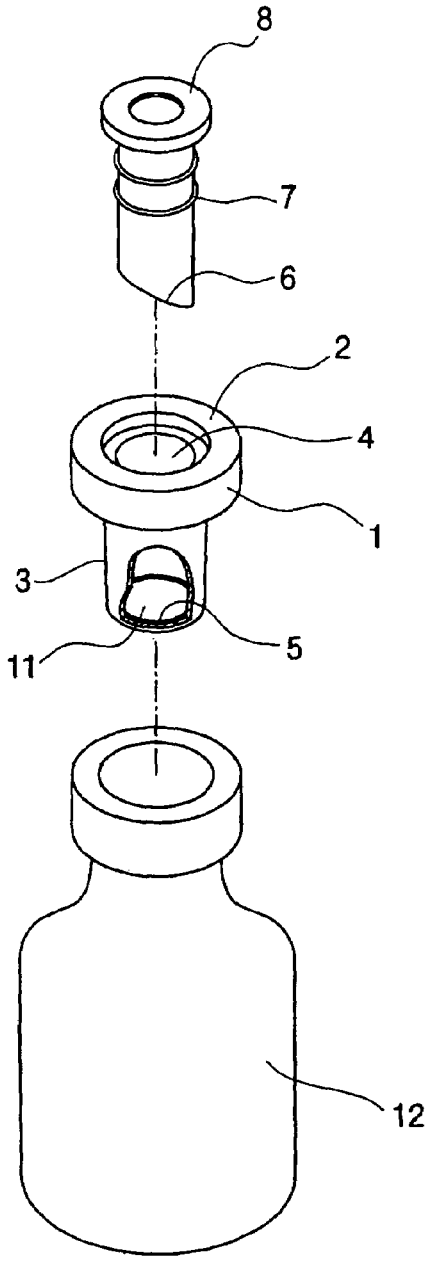
FIG. 1 Prior Art
FIG. 1 is an exploded perspective view showing a representative example of a prior art conventional cap.
Figure 2:
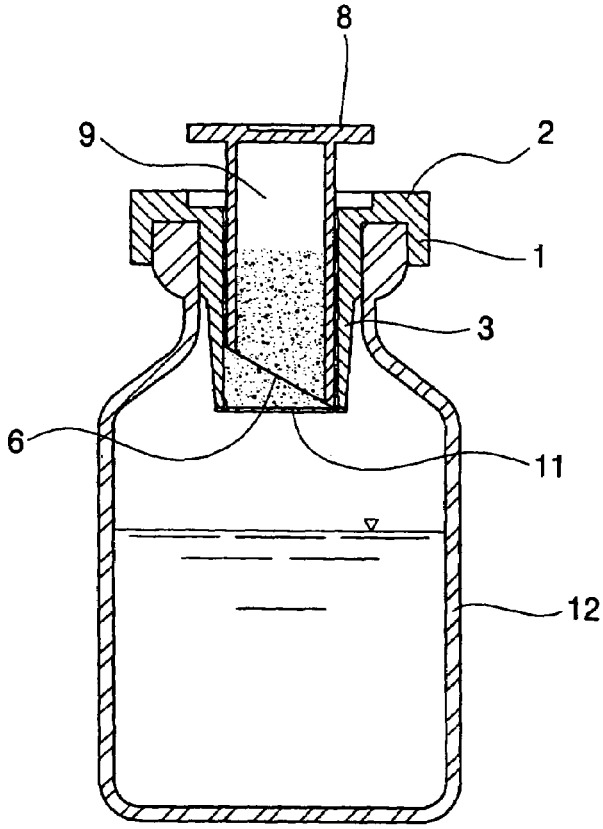
FIG. 2 Prior Art
FIG. 2 is a cross-sectional view showing the prior art cap of FIG. 1 coupled to a bottle.
Figure 3:
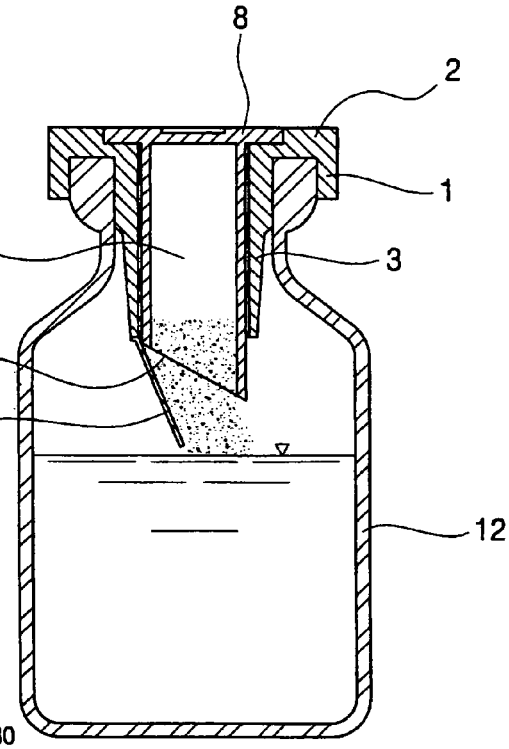
FIG. 3 Prior Art
FIG. 3 is a cross-sectional view showing usage of the cap of FIG. 2.
Figure 4:
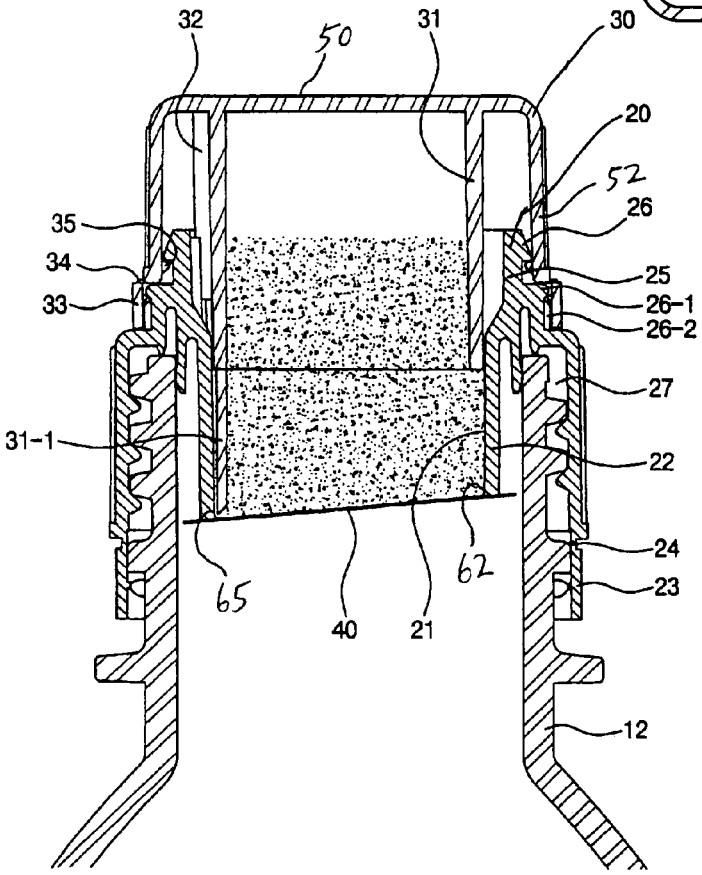
FIG. 4 is a cross-sectional view of an assembled double cap, according to a preferred embodiment of the present invention.
Figure 5:
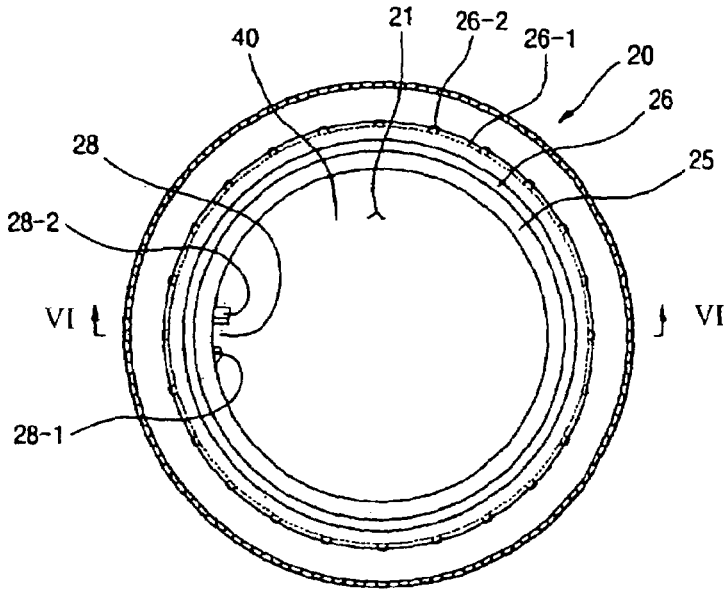
FIG. 5 is a top plan view of an isolated lower cap of the cap of the present invention.
Figure 6:
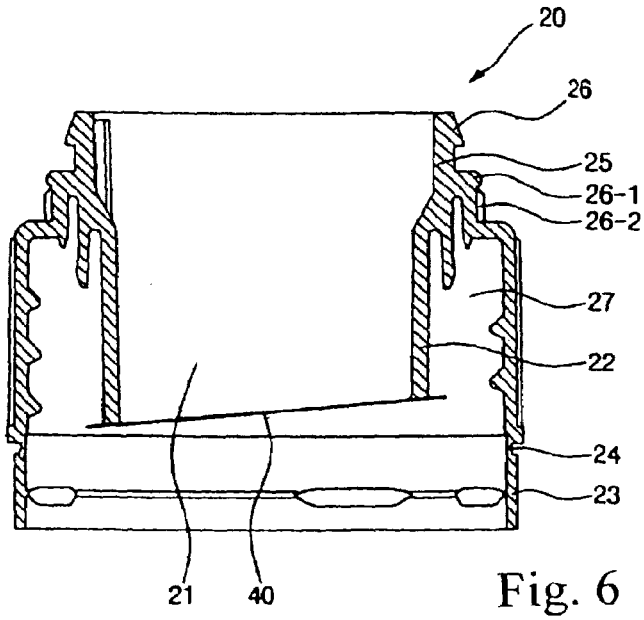
FIG. 6 is a cross-sectional view taken along the line I-I of FIG. 5.
Figure 7:
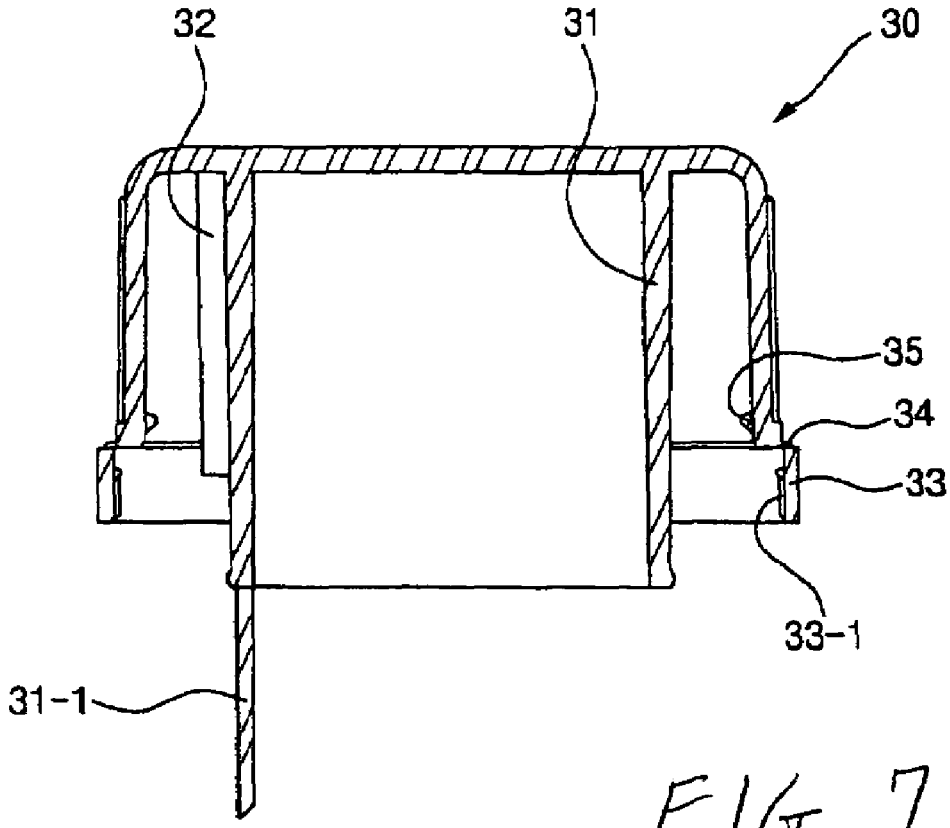
FIG. 7 is a longitudinal cross-sectional view of an isolated upper cap of the cap of the present invention.
Figure 8:
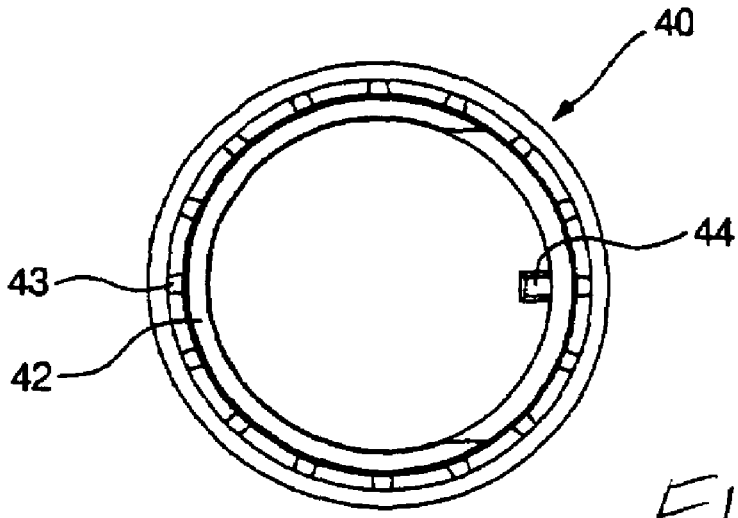
FIG. 8 is a bottom plan view of the upper cap of FIG. 7.

FIG. 4 is a cross-sectional view of an assembled cap, according to the preferred embodiment of the present invention. FIG. 5 is a top plan view of an isolated lower cap 20 of the cap of the present invention. FIG. 6 is a cross-sectional view taken along the line I-I of figure 5. FIG. 7 is a longitudinal cross-sectional view of an isolated upper cap 30 of the cap of the present invention, and figure 8 is a bottom plan view of the upper cap 30.

The cap according to the preferred embodiment of the present invention is coupled to the neck part of a drink container 12 to close the opening thereof, and has an adjunct receiving chamber which is defined within the cap.

The cap comprises an upper cap 30 and lower cap 20. The lower cap 20 is formed for detachable coupling to the neck part of the container 12. In the embodiment shown, the lower cap has an internal threading for rotatable engagement with exterior threading formed along the outer surface of the neck part of the container 12. The lower cap 20 has an insertion part 22, which defines an adjunct receiving chamber 21 therein and has an open bottom defining a bottom opening 59. The lower cap 20 further has a coupling part 25 which extends upwards from an upper end of the insertion part 22. The upper cap 30 is removably engaged to the coupling part 25 of the lower cap 20.

The upper cap 30 has a crown member 50 having an outer skirt 52 extending downward from around the crown member 50 and an inner skirt 31, which extends downwards from the crown member. The inner skirt 31 is positioned inward from the outer skirt 52.

The inner skirt 31 extends sufficiently to reach into the inner surface of the insertion part 22 of the lower cap 20. At least one push bar 31-1 extends a predetermined length from the inner skirt 31 to a position in the adjunct receiving chamber 21 corresponding to the deepest position of the adjunct receiving chamber 21 relative to a predetermined position of the inner skirt 31.

The cap further includes a bottom cover 40 covering the bottom opening 59 of the insertion part 22. The bottom cover 40 can be a sealing film which is coupled to a bottom circumferential edge 22-1 of the insertion part 22 surrounding the bottom opening 59 by ultrasonic sealing, so that the bottom cover 40 prevents the adjunct in the adjunct receiving chamber 21 from being removed. Furthermore, the push bar 31-1 is formed so that when the upper cap 30 is rotated, the push bar 31-1 cuts the bottom cover 40 to expose the bottom opening 59 and allow discharge of the adjunct from the adjunct receiving chamber 21.

The lower end of the insertion part 22 is angled with respect to a lateral direction. As shown in FIG. 4, the bottom circumferential edge 22-1 of the insertion part 22 surrounding the bottom opening 59 has a downward slope with respect to the lateral direction. The insertion part 22 has a peak portion 62 of the bottom circumferential edge 22-1 corresponding to an upper end of the downward slope, and the insertion part 22 has a base portion 65 of the bottom circumferential edge 22-1 corresponding to a lower end of the downward slope, The bottom cover 40 is coupled along the bottom circumferential edge 22-1 of the angled lower end of the insertion part 22, so that, when the push bar 31-1 is rotated along with the upper cap 30, the bottom cover 40 is cut by the push bar 31-1.

The outer surface of the inner skirt 31 and the inner surface of the insertion part 22 are coupled to each other through a positioning rib structure. When the inner skirt 31 and the insertion part 22 are coupled to each other by the positioning rib structure, the lower end of the push bar 31-1 is placed adjacent the base portion 65 of the insertion part 22.

In detail, the positioning rib structure comprises a rib 32 provided on the outer surface of the inner skirt and a rib positioning rail 28 provided on the inner surface of the insertion part 22. The rib positioning rail 28 comprises a small protrusion 28-1 on a first side thereof and a large protrusion 28-2 on a second side thereof The rib positioning rail 28 is constructed such that with rotational force exerted on the upper cap 30, the rib 32 of the inner skirt 31 can cross over the small protrusion 28-1 but cannot cross the large protrusion 28-2. The rotation of the upper cap 30 relative to the lower cap 20 and is stopped by the large protrusion 28-2. Thus, when the upper cap 30 is rotated once in one direction, the bottom cover 40 is cut, and when the upper cap 30 is further rotated in the same direction, the lower cap 20 is rotated along with the upper cap 30 by the rib 32 contacting the large protrusion 28-2, so that the lower cap 20 malt be removed from the container 12.

A lower security band 23 is removably coupled to a lower edge of the lower cap 20 through a lower security band connection member 24 provided between the lower security band 23 and the lower edge of the lower cap 20.

An upper security band 33, supported by an upper security band connection member 34, is provided under the upper cap 30 around the interface between the upper end of the lower cap 20 and the coupling part 25. Knurling 33-1 is formed on the inner surface of the upper security band 33, and knurling 26-2 is also formed on the lower cap 20 at a position corresponding to the knurling 33-1, so that the upper security band 33 maintains the coupled state thereof. Furthermore, a locking protrusion 26 is provided on the outer surface of the upper end of the coupling part 25, and a hook 35 is provided on the upper cap 30 to correspond to the locking protrusion 26, so that the upper cap 30 maintains the coupled state thereof while being capped. In the drawings, the reference numeral 26-1 denotes a stepped part. The lower end of the upper cap 30 other than the upper security band 33 is placed on the stepped part 26-1.

In the present invention having the above-mentioned structure, the bottom cover 40 can be a sealing film or another material suitable including but not limited to foil for covering the bottom opening 59 of the insertion part 22, and which can be cut with rotation of the push bar 31-1 to expose the bottom opening and allow a discharge of the adjunct from the adjunct receiving chamber 21. The bottom cover 40 can be integrally coupled to the bottom circumference edge 22-1 of the insertion part 22 surrounding the bottom opening 59 by ultrasonic welding, thus forming the bottom of the adjunct receiving chamber 21 defined by the insertion part 22. Thereafter, the adjunct receiving chamber 21 is filled with desired adjunct (including but not limited to a liquid, powdered, or granular adjunct), and the upper cap 30 is then coupled to the lower cap 20 such that the inner skirt 31 and the push bar 31-1 of the upper cap 30 are inserted into the insertion part 22 of the lower cap 20. At this time, the rib 32 of the inner skirt 31 is aligned with and inserted into the rib positioning rail 28 seen in FIG. 5. Then, the lower end of the push bar 31-1, which protrudes at the same position as the rib 32, is naturally placed at the lowest position in the insertion part 22 adjacent the base portion 65 of the bottom circumferential edge 22-1.

Subsequently, the opening of the container 12, containing contents therein, is closed by the cap, as shown in FIG. 4.

Figure 9:
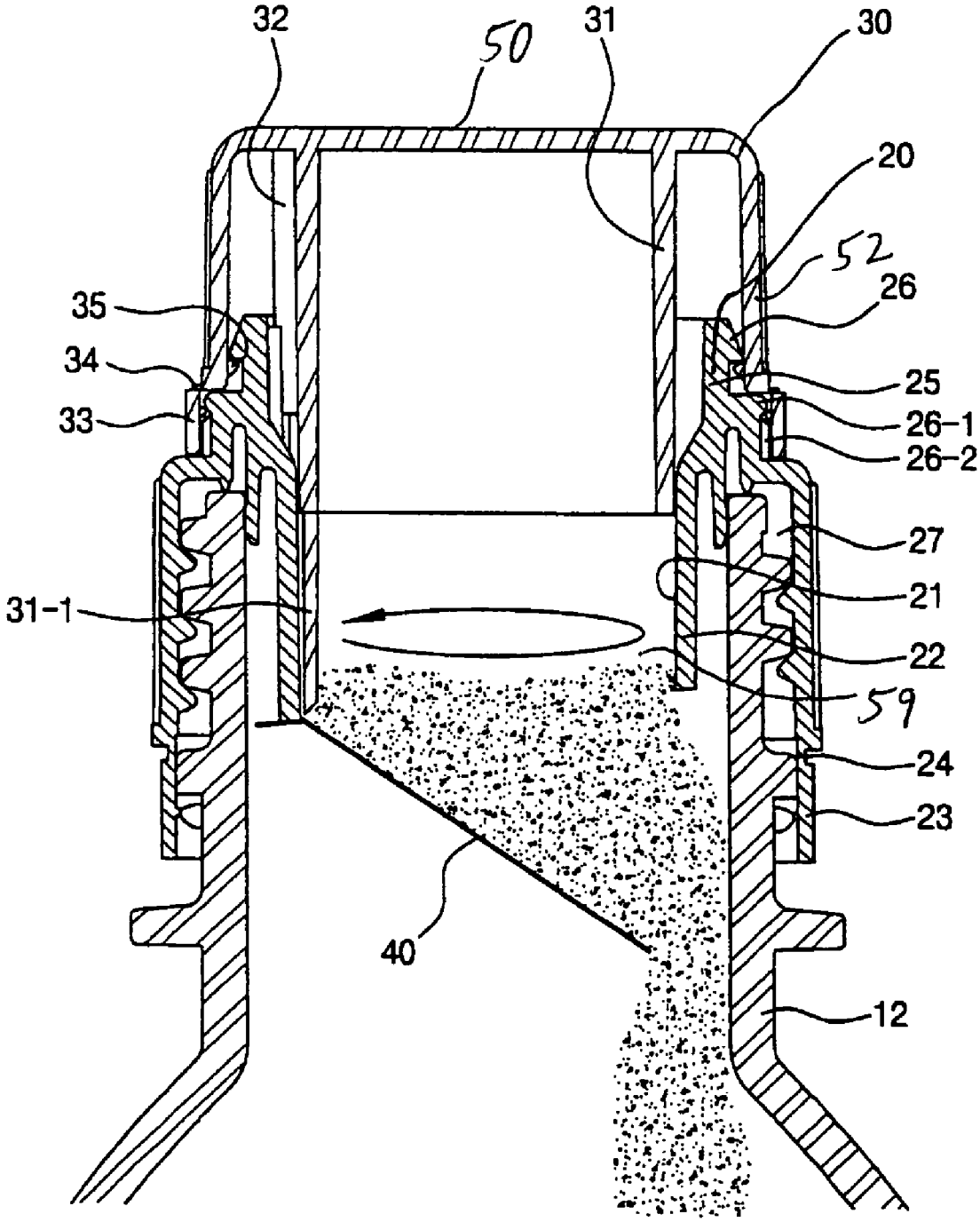
FIG. 9 is an assembled cross-sectional view showing usage of the double cap of FIG. 4.

To use the present invention when it has been used to cap a container 12, the upper cap 30 of FIGS. 7 and 8 is rotated once in a predetermined direction as seen in FIG. 5 with at least a sufficient predetermined force necessary to slide the rib 32 of the upper cap 30 over the small protrusion 28-1 seen in FIG. 5. The upper cap 30 makes one turn and the rotation thereof is stopped by the large protrusion 28-2. Thereby, the push bar 31-1, the lower end of which has been at the lowest position of the adjunct receiving chamber 21, cuts the bottom cover 40 to expose the bottom opening 59 of the insertion part 22. That is, because the bottom cover 40 is coupled to the bottom circumferential edge 22-1 of the insertion part 22, which is deeper moving from one side to the other side, and because the lower end of the push bar 31-1 has been at the lowest position of the insertion part 22, when the push bar 31-1 is rotated, the bottom cover 40 is cut by the push bar 31-1, as shown in FIG. 9.

While the upper cap 30 makes one turn, the bottom cover 40 is cut, and the rib 32 of the upper cap 30 is brought into contact with the large protrusion 28-2 of the lower cap 20. When the upper cap 30 is further rotated, because the rib 32 cannot cross over the large protrusion 28-2 of the lower cap 20, the lower cap 20 is forceably rotated along with the upper cap 30, so that the lower cap 20 and the upper cap 30 are released and removed from the container 12.

That is, in the present invention, when the upper cap 30 makes one turn, the rib 32 is rotated after crossing over the small protrusion 28-1 of FIG. 5 and, simultaneously, the push bar 31-1 cuts the bottom cover 40, so that the adjunct is mixed with the contents in the container 12. Subsequently, when the upper cap 30 is further rotated, the lower cap 20 may be removed from the container 12. Therefore, the present invention does not impose a separate adjunct addition process on a user and makes it possible for the user to use the contents mixed with the adjunct, thus being more convenient for the user.

Furthermore, when the upper cap 30 is rotated once, only the upper security band 33 remains, but the upper security band connection member 34, which couples the upper security band 33 to the upper cap 30, breaks. Therefore, the present invention lets the user know whether discharge of the adjunct in the cap has occurred. As well, when the lower cap 20 is rotated, the lower security band connection member 24 breaks, so that the lower security band 23 is separated from the lower cap 20, thus letting the user know whether the lower cap 20 has been detached from the container 12.

Meanwhile, if the upper cap 30 is pulled upwards, the hook 35 of the upper cap 30 is removed from the locking protrusion 26 of the lower cap 20, so that the upper cap 30 is removed from the lower cap 20. Therefore, the user may drink the contents of the container 12 through the adjunct receiving chamber 21 after removing the upper cap 30 from the lower cap 20. Alternatively, the user may drink the contents through the opening of the container 12 after removing the lower cap 20 from the container 12.

Although embodiments of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A cap comprising:

a lower cap having an insertion part defining an adjunct receiving chamber therein, said insertion part having a bottom opening;

a bottom cover covering the bottom opening of the insertion part;

an upper cap removeably coupled to the lower cap, said upper cap having an inner skirt extending downward from the upper cap;

a push bar extending downward from the inner skirt, said push bar having a lower end;

said push bar and bottom cover formed and positioned so that with rotation of the upper cap, the push bar cuts said bottom cover to expose the bottom opening of the insertion part;

said insertion part has a bottom circumferential edge surrounding the bottom opening;

said bottom circumferential edge of said insertion part has a downward slope with respect to a lateral direction;

said insertion part has a peak portion of the bottom circumferential edge corresponding to an upper end of the downward slope;

said insertion part has a base portion of the bottom circumferential edge corresponding to a lower end of the downward slope, said bottom cover is sealed onto the bottom circumferential edge to cover the bottom opening of the insertion part;

said push bar extends for a predetermined distance to the base portion of the bottom circumferential edge;

wherein an outer surface of the inner skirt of the upper cap and a portion of an inner surface of the insertion part which corresponds to the outer surface of the inner skirt are coupled to each other by a positioning rib structure so that when the inner skirt and the insertion part are coupled to each other, said lower end of the push bar is placed adjacent to the base portion of the bottom circumferential edge;

a rib provided on the outer surface of the inner skirt of the upper cap;

a rib positioning rail provided on the lower cap at the inner surface of the insertion part at a predetermined position corresponding the rib, said rib positioning rail comprising a small protrusion on a first side thereof and a large protrusion on a second side thereof; and, wherein said rib positioning rail is constructed such that the rib of the inner skirt can cross over the small protrusion and is stopped by the large protrusion, so that, when the upper cap is rotated in a predetermined direction, a cutting process of the bottom cover of the insertion part and rotation of the lower cap for removal are sequentially performed.

2. A cap comprising:

a lower cap having an insertion part defining an adjunct receiving chamber therein, said insertion part having a bottom opening;

a bottom cover covering the bottom opening of the insertion part;

an upper cap removeably coupled to the lower cap, said upper cap having an inner skirt extending downward from the upper cap;

a push bar extending downward from the inner skirt, said push bar having a lower end;

said push bar and bottom cover formed and positioned so that with rotation of the upper cap, the push bar cuts said bottom cover to expose the bottom opening of the insertion part;

an upper security band having an inner surface;

an upper security band connection member connecting the upper security band to the upper cap around the interface between said upper cap and the lower cap;

knurling formed on said inner surface of the upper security band; and, and knurling formed on an outer surface of said lower cap at a position corresponding to the knurling formed on said upper security band.

3. A cap for use with a container, said cap comprising:

a lower cap formed for rotatable coupling to a container;

said lower cap having an insertion part defining an adjunct receiving chamber therein, said insertion part having a bottom opening;

a bottom cover covering the bottom opening of the insertion part;

said insertion part having a bottom circumferential edge surrounding the bottom opening, said bottom circumferential edge of said insertion part having a downward slope with respect to a lateral direction, said insertion part having a peak portion of the bottom circumferential edge corresponding to an upper end of the downward slope, said insertion part having a base portion of the bottom circumferential edge corresponding to a lower end of the downward slope, said bottom cover is sealed onto the bottom circumferential edge to cover the bottom opening of the insertion part;

an upper cap removeably coupled to the lower cap, said upper cap having an inner skirt extending downward from the upper cap;

a push bar extending downward from the inner skirt, said push bar having a lower end, said push bar positioned to extend for a predetermined distance to the base portion of the bottom circumferential edge;

said push bar and bottom cover formed and positioned so that with rotation of the upper cap, the push bar cuts said bottom cover to expose the bottom opening of the insertion part;

wherein an outer surface of the inner skirt of the upper cap and a portion of an inner surface of the insertion part which corresponds to the outer surface of the inner skirt are coupled to each other by a positioning rib structure so that when the inner skirt and the insertion part are coupled to each other, said lower end of the push bar is placed adjacent to the base portion of the bottom circumferential edge;

a rib provided on the outer surface of the inner skirt of the upper cap, a rib positioning rail provided on the lower cap at the inner surface of the insertion part at a predetermined position corresponding to the rib;

said rib positioning rail has a small protrusion on a first side thereof and a large protrusion on a second side thereof; and, said rib positioning rail is constructed such that the rib of the inner skirt can cross over the small protrusion and is stopped by the large protrusion, so that, when the upper cap is rotated in a predetermined direction, a cutting process of the bottom cover of the insertion part and rotation of the lower cap for removal are sequentially performed.

4. A cap for use with a container, said cap comprising:

a lower cap formed for rotatable coupling to a container;

said lower cap having an insertion part defining an adjunct receiving chamber therein, said insertion part having a bottom opening;

a bottom cover covering the bottom opening of the insertion part;

said insertion part having a bottom circumferential edge surrounding the bottom opening, said bottom circumferential edge of said insertion part having a downward slope with respect to a lateral direction, said insertion part having a peak portion of the bottom circumferential edge corresponding to an upper end of the downward slope, said insertion part having a base portion of the bottom circumferential edge corresponding to a lower end of the downward slope, said bottom cover is sealed onto the bottom circumferential edge to cover the bottom opening of the insertion part;

an upper cap removeably coupled to the lower cap, said upper cap having an inner skirt extending downward from the upper cap;

a push bar extending downward from the inner skirt, said push bar having a lower end, said push bar positioned to extend for a predetermined distance to the base portion of the bottom circumferential edge;

said push bar and bottom cover formed and positioned so that with rotation of the upper cap, the push bar cuts said bottom cover to expose the bottom opening of the insertion part;

an upper security band having an inner surface;

an upper security band connection member connecting the upper security band to the upper cap around the interface between said upper cap and the lower cap;

knurling formed on said inner surface of the upper security band; and, and knurling formed on an outer surface of said lower cap at a position corresponding to the knurling formed on said upper security band.

* * * * *